US007030897B2

(12) United States Patent
Matsukawa

(10) Patent No.: US 7,030,897 B2
(45) Date of Patent: Apr. 18, 2006

(54) PHOTO PRINTER

(75) Inventor: Chiharu Matsukawa, Daito (JP)

(73) Assignee: Funai Electric Co., Ltd., Daito (JP)

( * ) Notice: Subject to any disclaimer, the term of this patent is extended or adjusted under 35 U.S.C. 154(b) by 98 days.

(21) Appl. No.: 10/867,770

(22) Filed: Jun. 16, 2004

(65) Prior Publication Data

US 2004/0257425 A1 Dec. 23, 2004

(30) Foreign Application Priority Data

Jun. 17, 2003 (JP) ..... 2003-172108

(51) Int. Cl.
*B41J 29/377* (2006.01)

(52) U.S. Cl. ..... 347/212; 347/175; 400/120.18

(58) Field of Classification Search ..... 347/175, 347/212; 400/120.03, 120.18
See application file for complete search history.

(56) References Cited

U.S. PATENT DOCUMENTS 5,825,396 A * 10/1998 Fujishiro ..... 347/212
5,825,397 A * 10/1998 Fujishiro ..... 347/212
6,084,624 A * 7/2000 Yamakawa ..... 347/175

FOREIGN PATENT DOCUMENTS

JP 5-104751 4/1993

* cited by examiner

*Primary Examiner*—Huan Tran
(74) *Attorney, Agent, or Firm*—Crowell & Moring LLP

(57) ABSTRACT

An image fixing portion includes a drum of cylindrical shape provided on a conveyance passage, a magenta fluorescent lamp and a yellow fluorescent lamp installed near the axis of the drum, and a fixing portion guide guiding the roll paper to be conveyed along the inner wall of the drum on the conveyance passage. The magenta fluorescent lamp and the yellow fluorescent lamp are disposed so that their axial direction may be coincident to the axial direction of the drum. When the image fixation is made, the roll paper is led into the drum. The roll paper has its image forming area alone led into the inside of the drum, so that light from each fluorescent lamp is applied to the image forming area alone.

7 Claims, 4 Drawing Sheets

PHOTO PRINTER

BACKGROUND OF THE INVENTION

1. Field of the Invention

The present invention relates to a photo printer for forming an image on a roll paper by heating, and then fixing the image by applying a light having a predetermined wavelength.

2. Description of the Related Art

The photo printer forms a full color image by repeating a process of image formation by heating of a thermal head and image fixation by applying ultraviolet radiation, using a roll paper having a laminate of three thermally coloring layers that are colored in three primary colors of Y (yellow), M (magenta) and C (cyan).

Referring to FIG. 5, an image forming and fixing process for the conventional photo printer will be described below. FIG. 5 is a schematic view showing successively an image forming and fixing process for the conventional photo printer. Reference numeral 3 denotes an image forming portion, 4 denotes an image fixing portion, 23, 24 denote a pair of conveying rollers for conveying a roll paper 100, and 61, 62 denote a pair of delivery rollers for use to carry in or out the roll paper. The image forming portion 3 includes a thermal head 31 for forming a predetermined image on the roll paper 100 by heating and a conveying roller 32 disposed at a position opposed to the thermal head 31 via the roll paper 100. The image fixing portion 4 includes the magenta fixing (M fixation) fluorescent lamps 41*a*, 41*b*, a reflector 42 surrounding them from the lower and side faces, the yellow fixing (Y fixation) fluorescent lamps 43*a*, 43*b*, a reflector 44 surrounding them from the lower and side faces, a shutter 45 for intercepting lights (ultraviolet rays) from the magenta fluorescent lamps 41*a*, 41*b* or yellow fluorescent lamps 43*a*, 43*b*, and a guide 46 for reciprocating the shutter 45 in the conveying direction of the roll paper 100.

First of all, one end of the roll paper 100 is forwarded up to a predetermined position in a direction to the delivery roller pair 61, 62, and pulled back in a direction to the image forming portion 3. Herein, the thermal head 31 of the image forming portion 3 is preheated at a (low) temperature for forming the yellow image, and forms an image (Y image) at a predetermined position at the temperature for forming the yellow image, while pulling in the roll paper 100 (FIG. 5A).

Then, the roll paper 100 having yellow image formed is forwarded in the direction to the delivery roller pair 61, 62 again, and the shutter 45 is moved over the yellow fixing fluorescent lamps 43*a*, 43*b* and the reflector 44 (FIG. 5B). Herein, the roll paper 100 is stopped at a position where a trailing end of an area where the yellow image is formed (Y image formed area) coincides with the leading end of the shutter 45.

Then, the yellow fixing fluorescent lamps 43*a*, 43*b* are lighted, and the roll paper 100 is pulled into the image forming portion 3 at a predetermined speed. In this case, the shutter 45 is moved toward the image forming portion 3, while a positional relation between the trailing end of the Y image formed area on the roll paper 100 and the leading end of the shutter 45 is kept (FIG. 5C). Thereby, light is only applied to the yellow image formed area of the roll paper 100 to fix the yellow image (Y fixation). Herein, the shutter 45 is moved together with the roll paper 100, thereby preventing light from the yellow fluorescent lamps 43*a*, 43*b* from being directly applied to the area where no image is formed (Y unfixed area) following the trailing end of the yellow image formed area (Y image formed area).

Then, the yellow fixing fluorescent lamps 43*a*, 43*b* are turned off, and the roll paper 100 is forwarded to the delivery portion 6. At this point of time, the shutter 45 is moved above the yellow fluorescent lamps 43*a*, 43*b* to open an upper part of the magenta fluorescent lamps 41*a*, 41*b*.

And the thermal head 31 is heated to a magenta image forming temperature (medium temperature), and performs an image formation (M image formation) in a predetermined area at the magenta image forming temperature, while pulling back the roll paper 100 (FIG. 5D).

Then, if the leading end of the roll paper 100 arrives to a predetermined position near an end portion of the reflector 42 on the side of the thermal head 31, the magenta fixing fluorescent lamps 41*a*, 41*b* are lighted, and the roll paper 100 is forwarded toward the delivery roller at a predetermined speed (FIG. 5E). If the trailing end of the magenta image forming area of the roll paper 100 arrives to the end portion of the reflector 42 on the side of the thermal head 3, the magenta fixing fluorescent lamps 41*a*, 41*b* are turned off (M fixation).

Thereafter, a cyan image is formed by the thermal head 31, though being not shown. Then, the roll paper 100 is forwarded to a predetermined position, cut into a predetermined size and carried out.

In a conventional image forming apparatus, a thermosensible recording medium of predetermined size is placed on the outer surface of a cylindrical drum provided internally with ultraviolet radiating lamps, and the image is formed from the outside by the thermal head and fixed with ultraviolet rays from the ultraviolet ray radiating lamps internally provided (refer to JP-A-5-104751).

However, in the photo printer as shown in FIG. 5, a yellow image fixing portion composed of the yellow fluorescent lamps and the reflector and a magenta image fixing portion composed of the magenta fluorescent lamps and the reflector are arranged in series in a roll paper conveying direction. Thereby, the outside dimension of the apparatus in this direction can not be reduced, depending on the size of two image fixing portions, especially the length size in the roll conveying direction. To radiate light evenly over the roll paper conveyed in a horizontal direction, a plurality of (two in FIG. 5) line light sources (fluorescent lamps) are needed. Furthermore, to prevent light radiated from the fluorescent lamps from being applied on an area of the roll paper where fixation is undesired, the shutter for intercepting light is linked. However, a mechanism for operating the shutter in accordance with a conveyance of the roll paper, for example, a combination of multiple gears and clutches, must be provided, making the structure more complex.

On the other hand, JP-A-5-104751 has a structure in which the thermosensible recording paper is pasted on the drum, whereby the cut paper of predetermined size is employed, and the roll paper can not be employed. The thermosensible recording paper must be replaced every time of printing, whereby the printing operation is very troublesome.

SUMMARY OF THE INVENTION

It is an object of the invention to provide a photo printer of small size and with a simple structure, in which the operation is easy due to use of the roll paper, and the image formation and fixation process is correctly performed.

This invention is characterized in that the image fixing device includes an outside portion of cylindrical shape having partly a notch, and a light radiating means for radiating the light, the light radiating means disposed inside the outside portion, wherein an image forming area of the roll paper is accommodated along an inner wall of the outside portion.

With this constitution, the outside shape of the image forming means is cylindrical, and the roll paper on which the image is formed is conveyed along the cylindrical inner wall. At this time, the roll paper has an image forming area alone conveyed from the notch portion in the outside portion of cylindrical shape along the cylindrical inner wall. If the roll paper is conveyed up to a predetermined position, the light radiating device provided inside the image fixing device of cylindrical shape is lighted to radiate light having a predetermined wavelength to the image forming area on the roll paper. The light radiating device is turned off after radiating light for a certain time, and the roll paper is pulled back to a position where the top end is out of the image fixing device. In this way, the image forming area alone is conveyed inside and subjected to light, whereby it is unnecessary to provide the shutter to prevent unneeded light from being applied to the image unformed area on the roll paper. Moreover, since the shutter is not required, it is unnecessary to provide a mechanism for moving the shutter along with the movement of the roll paper, whereby the structure becomes simpler.

This invention is characterized in that the image fixing device includes a conveyance assisting device for leading the roll paper along the inner wall.

With this constitution, since the image fixing device of almost cylindrical shape is provided with the conveyance assisting device, a curl at the top end of the roll paper or the conveying direction of the roll paper is regulated to convey the roll paper along the inner wall correctly.

This invention is characterized in that the image fixing device includes a light intercepting device for intercepting light from the light radiating device near the notch of the outside portion.

With this constitution, since the image fixing device of cylindrical shape includes the light intercepting device near the notch, light radiated from the light radiating device of the image fixing device is restrained from leaking out of the image fixing device, and prevented from being applied to the unfixed area (image unformed area) of the roll paper.

This invention is characterized in that the light radiating device is composed of a plurality of line light sources disposed at the positions substantially at a central axis of the outside portion of cylindrical shape along the central axis.

With this constitution, since the light radiating device is disposed in the center of the outside portion of cylindrical shape in the image fixing device, one line light source (e.g., fluorescent lamp) can radiate light at almost same intensity over the entire face of the roll paper placed on the cylindrical inner wall.

This invention is characterized in that the roll paper has a plurality of thermally coloring layers on which images are formed at different heating temperatures, and fixed by lights having different wavelengths depending on the heating temperatures, and the light radiating device is composed of a plurality of light sources for radiating a light having a wavelength in accordance with an image to be fixed.

With this constitution, since the plurality of light sources with different wavelengths are disposed within one image fixing device, it is unnecessary to provide the image fixing device for each light source for radiating light having a required wavelength for each color, whereby the full color image printing apparatus is simplified and reduced in size.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

A photo printer according to an embodiment of the present invention will be described below with reference to the accompanying drawings. In the following explanation, the photo printer of a TA method (thermo auto-chrome method or direct photosensitive recording method of light fixation type) is taken as an example. Herein, the TA method involves forming a full-color image by repeating the image formation by heating and the image fixation by ultraviolet radiation on a TA paper which has a laminate of three thermal coloring layers that are colored in three primary colors of yellow (Y), magenta (M) and cyan (C).

Figure 1A:
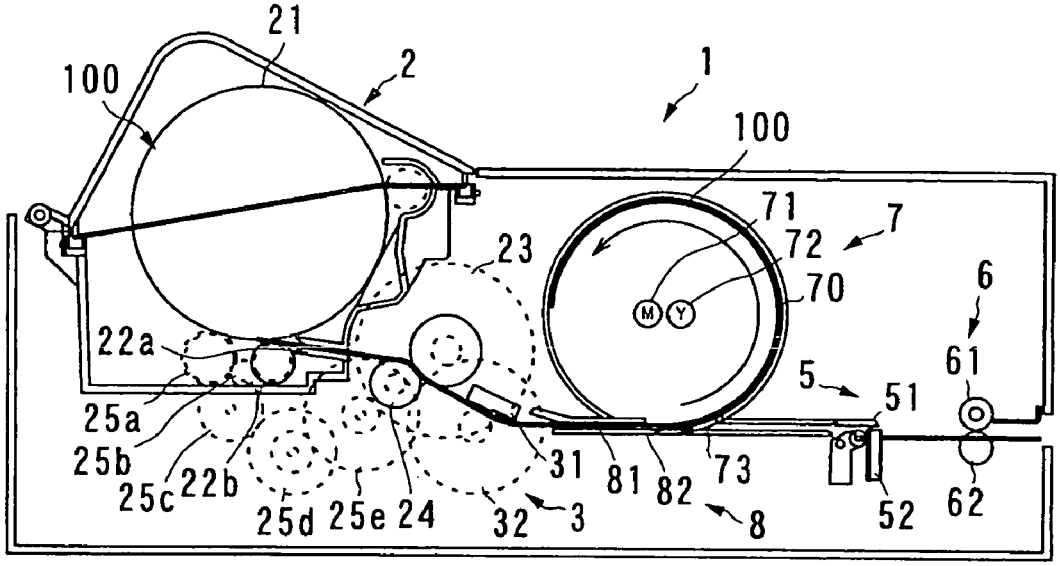
FIG. 1 is a schematic view showing a principal portion of a photo printer according to an embodiment of the invention.
Figure 1B:
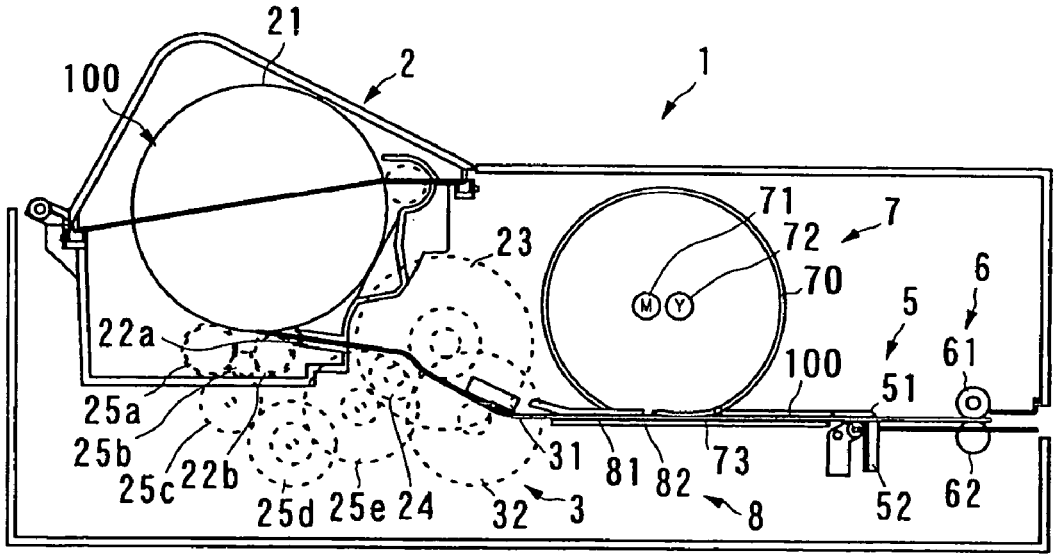

FIG. 1 is a schematic view showing a principal portion of the photo printer of the invention. FIG. 1A shows a case where a roll paper 100 is inserted into a drum 7 of an image fixing portion 7 and FIG. 1B shows a case where the roll paper 100 is forwarded in a direction to a delivery portion 6, As shown in FIG. 1, the photo printer 1 of this embodiment includes a paper feeding portion 2, an image forming portion 3, an image fixing portion 7, a cutting portion 5, the delivery portion 6, a conveyance passage 8, and a control portion, not shown.

The paper feeding portion 2 includes a roll paper holding member 21 for holding the roll paper 100 that is a continuous form of TA paper wound around a cylindrical core, a paper feed guide 22*a* and a guide roller 22*b* for leading the roll paper 100 in a direction to the image forming portion 3, a pair of conveying rollers 23, 24 for controlling the feed of the roll paper 100, and the gears 25*a* to 25*e* for synchronizing the rotation of each roller.

The image forming portion 3 includes a thermal head 31 for forming an image by heating the roll paper 100 at a predetermined temperature, and a conveying roller 32 disposed at a position opposed to the thermal head 31 via the roll paper 100. The thermal head 31 is disposed on the side where the photographic body of the roll paper 100 is formed as a laminate (upper side of the roll paper 100 in the figure). The thermal head 31 is connected to a temperature controller (not shown) for controlling the temperature of the thermal head 31 so that the thermal head may have the temperature according to the color of the image to be formed.

The image fixing portion 7 includes a cylindrical drum 70 provided above the conveyance passage 8 and having partly a notch, with its axial direction being the width direction of the roll paper 100, a magenta fluorescent lamp 71 and a yellow fluorescent lamp 72 installed near a central axis of the drum 70, and a fixing portion guide 73 for leading the roll paper 100 from the conveyance passage 8 via the notch portion of the drum 70 along the inner wall into the drum 70. Herein, the magenta fluorescent lamp 71 and the yellow fluorescent lamp 72 are disposed so that their axial direction may be coincident to the central axis direction of the drum 70. The fixing portion guide 73 is rotated to a lower end of the conveyance passage 8, when fixing the roll paper 100, as shown in FIG. 1A, or rotated to an upper end of the conveyance passage 8, when carrying out the roll paper 100, as shown in FIG. 1B.

The cutting portion 5 includes a cutter 51 for cutting the roll paper 100, and a cutter moving mechanism 52 for moving the cutter 51 in a width direction of the roll paper 100. The delivery portion 6 includes a pair of delivery rollers 61, 62 for carrying out a sheet of paper cut into a predetermined size at the cutting portion 5. The control portion 7 controls the operation of each unit.

The operation of the photo printer 1 according to this embodiment will be described below.

The roll paper 100 is led from the roll paper holding member 21 of the paper feeding portion 2 via the paper feed guide 22*a* and the guide roller 22*b* through the conveying roller pair 23, 24 to the image forming portion 3. The fixing portion guide 73 of the fixing portion 7 is located on the side of an upper guide 81 of the conveyance passage 8. The roll paper 100 passing through the image forming portion 3 is led on the conveyance passage 8 to the cutting portion 5, whereby a part of the roll paper having a predetermined length from the top end (marginal part) is cut by the cutter 51. Thereby, the part affected due to a leakage of illuminating light in the previous image formation and fixation process on the roll paper 100 is deleted.

Then, the image forming portion 3 forms an image on the roll paper 100 by heating a predetermined area (image forming area) from the top end of the roll paper 100 with the thermal head 31, while pulling back the roll paper 100. Herein, the thermal head 31 is held at the yellow heating temperature (low temperature) and forms a yellow image by heating the roll paper 100 at low temperatures.

The roll paper 100, on which the yellow image is formed, is led to the conveyance passage 8. The fixing portion guide 73 of the image fixing portion 7 is rotated to the side of the lower guide 82 on the conveyance passage 8 at this point of time, so that the roll paper 100 led to the conveyance passage 8 is conveyed from the notch portion of the drum 70 along the inner wall with the fixing portion guide 73. And if the roll paper 100 is conveyed into the drum 70 by an amount of the image forming area, the conveyance of the roll paper 100 is stopped, so that the yellow fluorescent lamp 72 is lighted up to radiate ultraviolet rays having the wavelength for yellow fixation. Since only the image forming area of the roll paper 100 is stopped along the inner wall of the drum 70, radiant ultraviolet rays from the yellow fluorescent lamp 72 placed extremely near the axial center of the drum 70 are applied at the almost same intensity over the entire image forming area. Thereby, the yellow image is fixed evenly over the entire image forming area.

The roll paper 100, on which the yellow image is fixed, has a magenta image formed, while being pulled back to the image forming portion 3. The magenta image is formed in the same manner as the yellow image, while the heating temperature of the thermal head 31 is kept at a medium temperature higher than the heating temperature for yellow image.

The roll paper 100, on which the magenta image is formed, is led to the image fixing portion 7 again. That is, the roll paper 100 is conveyed in a state where the top end of the fixing portion guide 73 lies at the lower guide 82 on the conveyance passage 8, whereby only the image forming area of the roll paper 100 is led along the inner wall of the drum 70.

The image fixing portion 7 lights the magenta fluorescent lamp 71 to radiate the ultraviolet rays having the wavelength for magenta fixation. In this case, since only the image forming area of the roll paper 100 is stopped along the inner wall of the drum 70, radiant ultraviolet rays from the magenta fluorescent lamp 71 placed extremely near the axial center of the drum 70 are applied at the almost same intensity over the entire image forming area. Thereby, the magenta image is fixed evenly over the entire image forming area.

The roll paper 100, on which the magenta image is fixed, has a cyan image formed, while being pulled back to the image forming portion 3. The cyan image is formed in the same manner as the yellow image and the magenta image, while the heating temperature of the thermal head 31 is kept at a high temperature above the heating temperature for magenta image.

Since the cyan image does not need any fixation process, the roll paper 100 having the cyan image formed is led via the conveyance passage 8 to the cutting portion 5. That is, the fixing portion guide 73 is rotated so that the top end of the fixing portion guide 73 may be located on the side of the upper guide 81 on the conveyance passage 8, whereby the roll paper 100 having the cyan image formed that is carried out of the image forming portion 3 is led to the cutting portion 5.

The cutting portion 5 cuts the roll paper 100 having the cyan image formed and thus the full-color image formed in a predetermined size, and the delivery portion 6 carries the full-color image printing paper of predetermined size out of the photo printer 1.

As previously described, the image fixing portion is formed cylindrically and only the image forming area of the roll paper is led along the inner wall and subjected to ultraviolet rays, whereby it is unnecessary to provide the shutter for preventing ultraviolet rays from being applied to the image unformed area of the roll paper, and the constitution of the apparatus is simplified. It is unnecessary to provide a drive system for synchronizing the movement of the shutter with the conveyance of the roll paper as conventionally performed, whereby the constitution of the apparatus is further simplified.

The fluorescent lamp for each wavelength is disposed near the axis of the drum to apply the ultraviolet rays at the almost same intensity over the entire image forming area of the roll paper led along the inner wall of the drum. Thereby, the number of fluorescent lamps is lessened and the apparatus cost is reduced.

A plurality of fluorescent lamps having different wavelengths are disposed near the axis of the drum, whereby a plurality of colors can be fixed on one drum. Thereby, the apparatus is simplified and reduced in size without providing the image fixing portion for each color to be fixed.

Owing to the use of the roll paper, once the roll paper is set on the paper feeding portion, a full-color image prints (photographs) having a predetermined size can be easily produced by a predetermined number of sheets over the length of the set roll paper. That is, there is no labor for setting each cut sheet on the apparatus to print the image, using the thermosensible recording paper precut in a predetermined size, whereby a number of images can be easily printed continuously.

Figure 2:
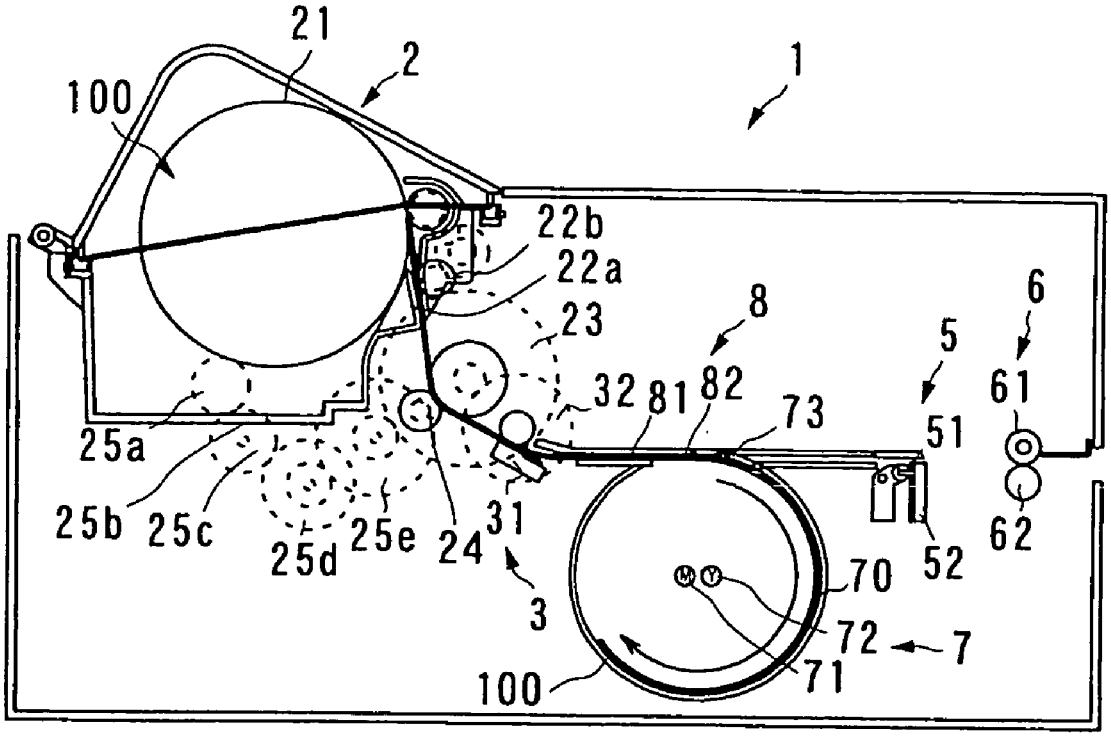
FIG. 2 is a schematic view showing another constitution of the photo printer according to the embodiment of the invention.

In the previous embodiment, the image fixing portion 7 is disposed above the conveyance passage 8, but may be disposed under the conveyance passage 8 as shown in FIG. 2. In this case, the thermal head 3 is disposed under the roll paper 100, and the roll paper 100 is set from the reverse direction on the paper feeding portion 2.

Figure 3:
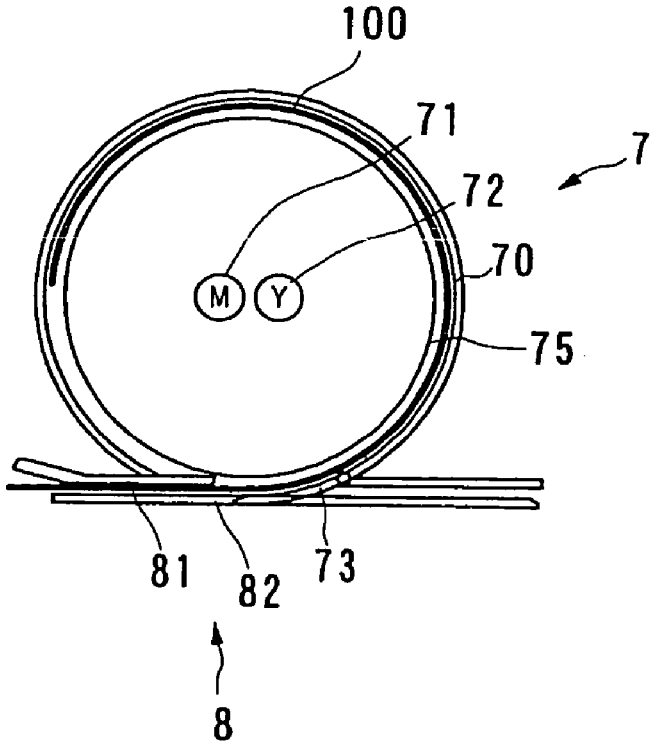
FIG. 3 is an enlarged view showing an image fixing portion of another constitution of the photo printer according to the embodiment of the invention.

In the previous embodiment, the roll paper is simply conveyed and led along the inner wall of the drum 70. However, a transparent conveyance guide 75 (corresponding to a conveyance assisting device of this invention) of cylindrical shape, having an outer diameter smaller by a predetermined amount than the inner diameter of the drum 70 and capable of transmitting the ultraviolet rays, may be installed inside the drum 70, as shown in FIG. 3. By installing this conveyance guide 75, it is possible to prevent occurrence of a failure in which the roll paper 100 is not conveyed along the inner wall of the drum 70 due to a curl at the top end of the roll paper 100.

In the previous embodiment, if the fixing portion guide 73 and its neighboring conveyance passage 8 are shaped as shown in FIG. 4, and operated in the following way, it is possible to further prevent a leakage of illuminating light to the image unformed area on the roll paper 100.

Figure 4A:
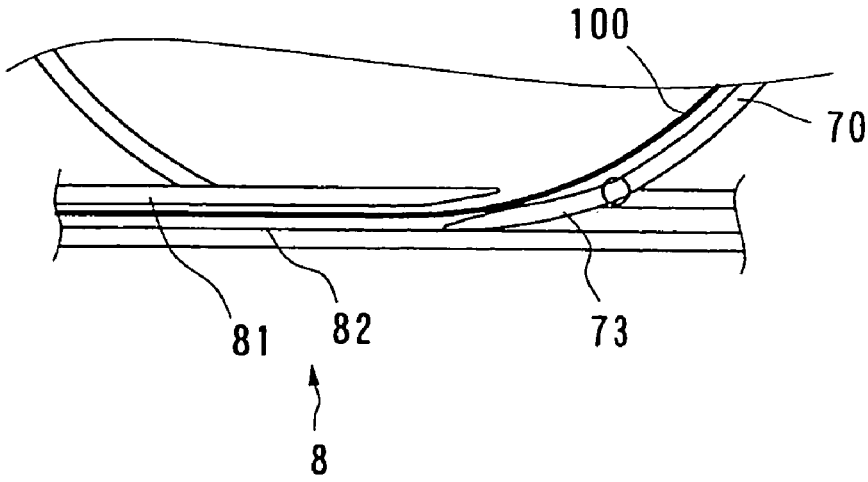
FIG. 4 is an enlarged view showing the image fixing portion (near a fixing portion guide) of another constitution of the photo printer according to the embodiment of the invention.
Figure 4B:
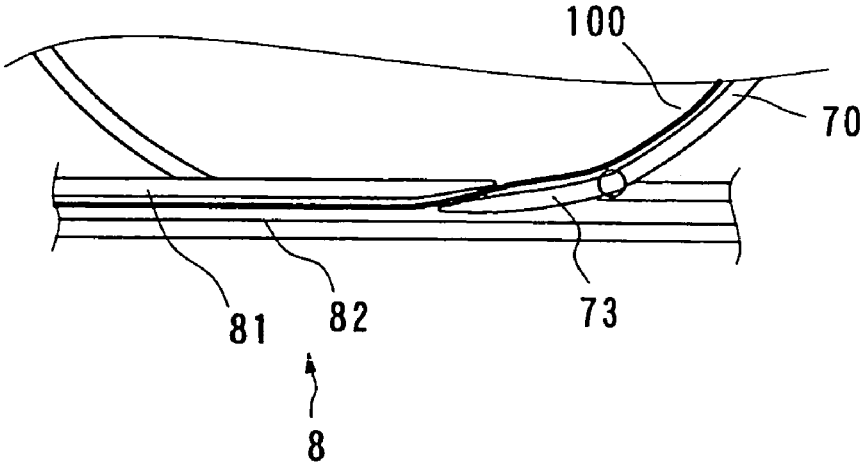
Figure 4C:
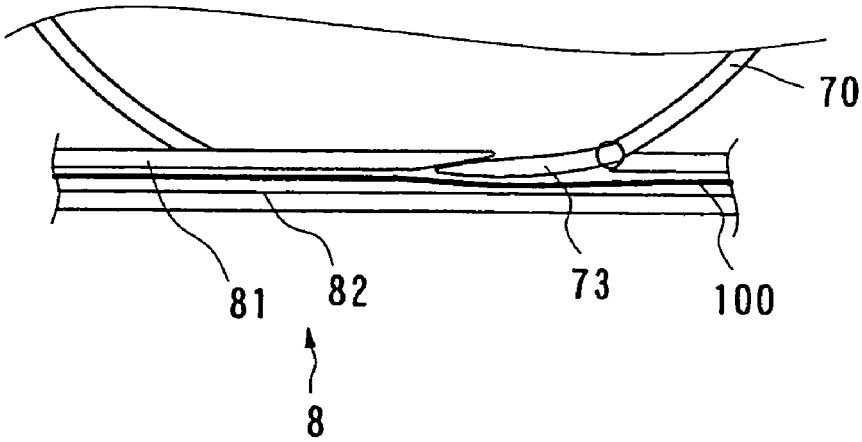
Figure 5A:
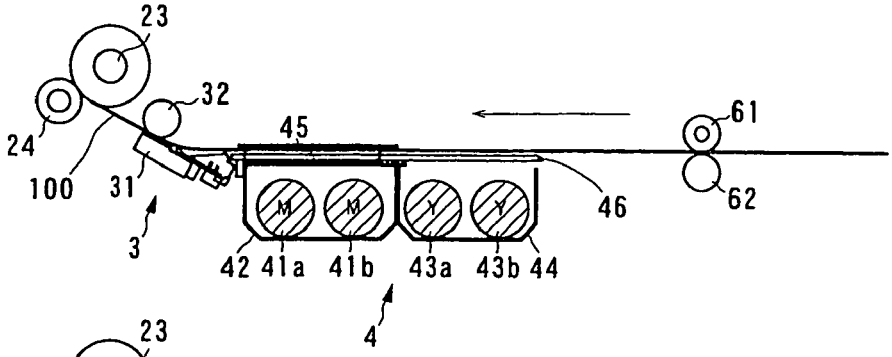
FIG. 5 is a schematic view showing the operation of the conventional photo printer.
Figure 5B:
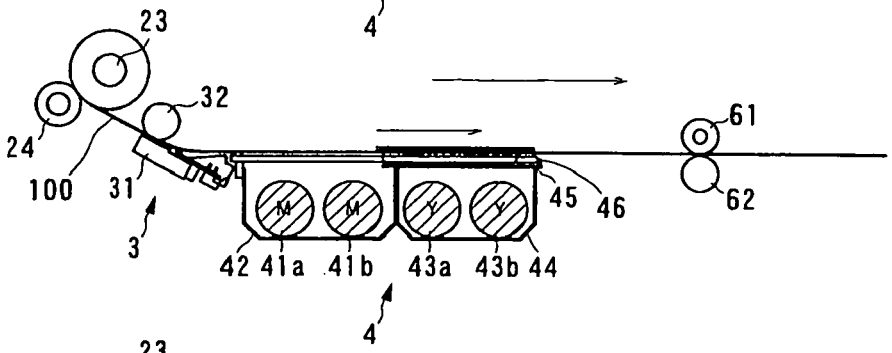
Figure 5C:
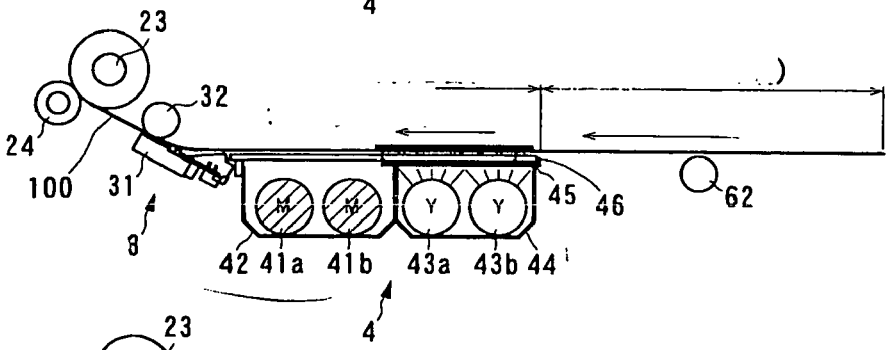
Figure 5D:
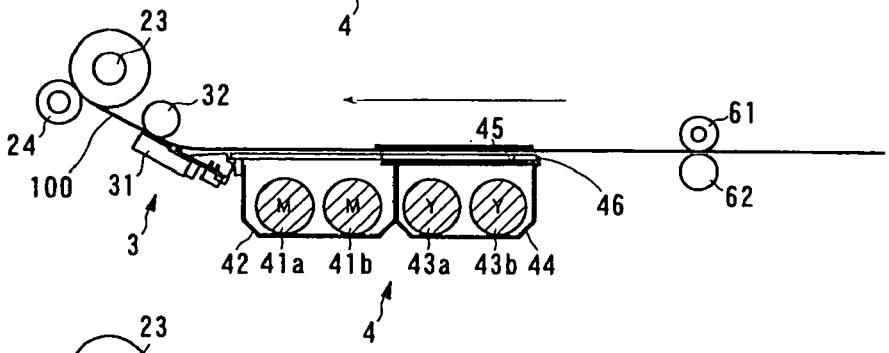
Figure 5E:
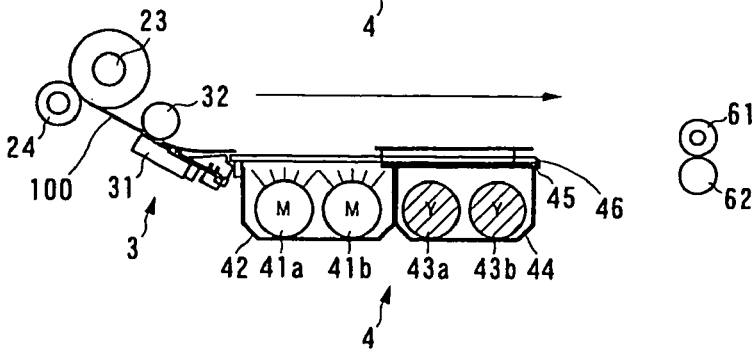

FIG. 4 is a schematic view showing a structure of the fixing portion guide). FIG. 4A is a case where the roll paper is led into the drum, FIG. 4B is a case where the ultraviolet ray is applied, and FIG. 4C is a case where the roll paper is led to the cutting portion.

The fixing portion guide 73 has a tapered shape, as shown in FIG. 4. The guide 81 on the conveyance passage 8 has a tapered shape like the fixing portion guide 73.

When the roll paper 100 is led into the drum 70, the fixing portion guide 73 is rotated to the position where its top end is contact with the lower guide 82 on the conveyance passage 8, and stopped, as shown in FIG. 4A. And if the entire image forming area of the roll paper 100 is led into the drum 70, the fixing portion guide 73 is rotated by a predetermined amount upwards of the conveyance passage 8 and stopped, as shown in FIG. 4B. Herein, the fixing portion guide 73 is stopped at a position where the roll paper 100 is carried to the extent that unnecessary pressure is not applied on the roll paper 100. In this way, the fixing portion guide 73 having a taper shape is made to approach the roll paper 100 and the upper guide 81, thereby preventing leakage, and can function as a light intercepting device of the invention. When the roll paper 100 is conveyed to the cutting portion 5, the fixing portion guide 73 is rotated to the position where it is contact with the upper guide 81 on the conveyance passage 8, and stopped.

With this invention, since the image forming area alone is conveyed into the inside of the drum of almost cylindrical shape in the image fixing portion, and subjected to light, it is unnecessary to provide the shutter to prevent unneeded light from being applied to the image unformed area on the roll paper. Moreover, since the shutter is not required, it is unnecessary to provide a mechanism for moving the shutter along with the movement of the roll paper, whereby the photo printer with a simple structure is realized.

With this invention, since the image fixing device of almost cylindrical shape is provided with the conveyance assisting device, a curl at the top end of the roll paper or the conveying direction of the roll paper is regulated to convey the roll paper along the inner wall correctly.

With this invention, since the image fixing device includes the light intercepting device near the notch in the outside portion of cylindrical shape, light radiated from the line light source of the image fixing device is restrained from leaking out of the image fixing device, and prevented from being applied to the unfixed area (image unformed area) of the roll paper.

With this invention, since the line light source is disposed in the center of the outside portion of cylindrical shape, one line light source can radiate light at almost same intensity over the entire face of the roll paper placed on the cylindrical inner wall. Thereby, the number of line light sources is reduced, and the apparatus has the smaller cost.

With this constitution, since the plurality of light sources with different wavelengths are disposed within one image fixing device, it is unnecessary to provide respective image fixing device for each light source for radiating light having a required wavelength for each color, whereby the full color image printing apparatus is simplified and reduced in size.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A photo printer comprising:

image forming means for forming an image by heating a roll paper having a plurality of thermally coloring layers on which images are formed at different heating temperatures, and fixed by lights having different wavelengths depending on the heating temperatures;

image fixing means for fixing the image by applying a light to the roll paper on which the image is formed by the image forming means; wherein the image fixing means includes;

an outside portion of cylindrical shape for accommodating an image forming area of the roll paper along an inner wall of the image fixing means, the outside portion having partly a notch;

light radiating means including a plurality of line light sources for radiating a light having a wavelength in accordance with an image to be fixed, the plurality of line light sources being disposed at the positions substantially the same as a central axis of the outside portion of cylindrical shape along the central axis;

light intercepting means for intercepting light from the light radiating means, the light intercepting means provided near the notch; and conveyance assisting means for leading the roll paper along the inner wall.

2. A photo printer comprising:

image forming means for forming an image by heating a roll paper; and image fixing means for fixing the image by applying a light to the roll paper on which the image is formed by the image forming means, wherein the image fixing means includes;

an outside portion of cylindrical shape having partly a notch; and light radiating means for radiating the light, the light radiating means disposed inside the outside portion, and an image forming area of the roll paper is accommodated along an inner wall of the outside portion of the image fixing means.

3. The photo printer according to claim 2, wherein the image fixing means includes conveyance assisting means for leading the roll paper along the inner wall.

4. The photo printer according to claim 2, wherein the image fixing means includes light intercepting means for intercepting light from the light radiating means near the notch.

5. The photo printer according to claim 2, wherein the light radiating means includes a plurality of line light sources disposed at the positions substantially corresponding to a central axis of the outside portion along the central axis.

6. The photo printer according to claim 2, wherein the roll paper has a plurality of thermally coloring layers on which images are formed at different heating temperatures, and fixed by lights having different wavelengths depending on the heating temperatures, and the light radiating means includes a plurality of light sources for radiating a light having a wavelength in accordance with an image to be fixed.

7. A photo printer comprising:

an image forming device forming an image by heating a roll paper having a plurality of thermally coloring layers on which images are formed at different heating temperatures, and fixed by lights having different wavelengths depending on the heating temperatures;

an image fixing device fixing the image by applying a light to the roll paper on which the image is formed by the image forming device; wherein the image fixing device includes;

an outside portion of cylindrical shape for accommodating an image forming area of the roll paper along an inner wall of the image fixing device, the outside portion having partly a notch;

a light radiating device including a plurality of line light sources for radiating a light having a wavelength in accordance with an image to be fixed, the plurality of line light sources being disposed at the positions substantially the same as a central axis of the outside portion of cylindrical shape along the central axis;

a light intercepting device intercepting light from the light radiating device, the light intercepting device provided near the notch; and a conveyance assisting device leading the roll paper along the inner wall.

* * * * *